US007918163B2

(12) United States Patent
Dahlberg

(10) Patent No.: US 7,918,163 B2
(45) Date of Patent: Apr. 5, 2011

(54) PROGRESSIVE PROPELLANT CHARGE WITH HIGH CHARGE DENSITY

(75) Inventor: Johan Dahlberg, Örebro (SE)

(73) Assignee: Eurenco Bofors AB, Karlskoga (SE)

( * ) Notice: Subject to any disclaimer, the term of this patent is extended or adjusted under 35 U.S.C. 154(b) by 0 days.

(21) Appl. No.: 10/582,111

(22) PCT Filed: Dec. 8, 2004

(86) PCT No.: PCT/SE2004/001820

§ 371 (c)(1),
(2), (4) Date: Apr. 17, 2007

(87) PCT Pub. No.: WO2005/057123

PCT Pub. Date: Jun. 23, 2005

(65) Prior Publication Data

US 2008/0047453 A1 Feb. 28, 2008

(30) Foreign Application Priority Data

Dec. 9, 2003 (SE) ..... 0303300

(51) Int. Cl.
*C06B 45/12* (2006.01)

(52) U.S. Cl. ..... 102/288; 102/290; 102/286

(58) Field of Classification Search ..... 102/286, 102/289, 290, 283, 285, 287
See application file for complete search history.

(56) References Cited

U.S. PATENT DOCUMENTS 677,527 A * 7/1901 Maxim ..... 102/288
(Continued)

FOREIGN PATENT DOCUMENTS

DE 19917633 11/2000
(Continued)

OTHER PUBLICATIONS

International Search Report No. PCT/SE2004/001820, dated Jan. 3, 2005, 2 pgs.

(Continued)

*Primary Examiner* — James S Bergin
*Assistant Examiner* — Daniel J Troy
(74) *Attorney, Agent, or Firm* — Connolly Bove Lodge & Hutz LLP

(57) ABSTRACT

The resent invention relates to a method for producing propellant charges with progressive combustion characteristic and a higher charge density than previously considered possible to achieve, intended in the first instance for direct-firing barrel weapons such as tank cannons. Combined in the charge that is characteristic of the invention are at least two radially perforated propellant tubes (10-12, 28-30, 48-52) which are arranged in their entirety inside or after one another, which process, at an e-dimension selected in relation to the actual type of propellant and its desired combustion characteristic, combustion or ignition channels (2, 19-21, 37), and which have circular outer and inner boundary surfaces, in conjunction with which, before initiation of the charge, at least one of the total number of outer surfaces of these propellant tubes that are available for initiation has been treated with an inhibition, surface treatment or surface coating (13-18, 33-36) intended to delay the propagation of ignition to that surface, so that the combustion of the propellant tubes is partially mutually overlapping and taken together, gives rise to a maximum propellant gas pressure behind a projectile fired with the charge from the barrel in question, which pressure, for the entire passage of the projectile through the barrel, lies close to the applicable Pmop value for the barrel (the maximum operational pressure, i.e. the highest barrel pressure that can be permitted continuously).

22 Claims, 3 Drawing Sheets

U.S. PATENT DOCUMENTS

| | | | | | |
|---|---|---|---|---|---|
| 677,528 | A | * | 7/1901 | Maxim | 102/288 |
| 694,295 | A | * | 2/1902 | Maxim | 102/288 |
| 766,455 | A | * | 8/1904 | Maxim | 102/283 |
| 3,028,810 | A | * | 4/1962 | Proell | 102/290 |
| 3,099,963 | A | * | 8/1963 | Dobrin et al. | 102/290 |
| 3,256,819 | A | * | 6/1966 | Leeper | 102/531 |
| 3,688,697 | A | * | 9/1972 | Paul et al. | 102/431 |
| 3,889,463 | A | * | 6/1975 | San Miguel | 60/255 |
| 3,898,934 | A | * | 8/1975 | Mercier et al. | 102/285 |
| 4,840,025 | A | * | 6/1989 | Coffinberry | 60/219 |
| 4,876,962 | A | * | 10/1989 | Olsson | 102/288 |
| 5,042,385 | A | * | 8/1991 | Reed et al. | 102/290 |
| 5,251,549 | A | | 10/1993 | Boisseau et al. | |
| 5,269,224 | A | * | 12/1993 | Gonzales et al. | 102/288 |
| 5,682,013 | A | * | 10/1997 | Smith et al. | 149/6 |
| 6,071,444 | A | | 6/2000 | Worrell, Jr. et al. | |
| 2004/0216823 | A1 | * | 11/2004 | Dahlberg et al. | 149/109.6 |
| 2005/0066835 | A1 | * | 3/2005 | Hafstrand | 102/291 |
| 2008/0047453 | A1 | | 2/2008 | Dahlberg | |

FOREIGN PATENT DOCUMENTS

| | | |
|---|---|---|
| EP | 0304099 | 11/1989 |
| FR | 2433730 | 3/1980 |
| GB | 2011589 | 7/1979 |
| RU | 93037046 | 8/1995 |
| SE | 526922 | 11/2005 |
| WO | WO-02083602 | 10/2002 |

OTHER PUBLICATIONS

Official Decision of Grant from the Patent Office of the Russian Federation issued Mar. 24, 2009.

* cited by examiner

PROGRESSIVE PROPELLANT CHARGE WITH HIGH CHARGE DENSITY

TECHNICAL FIELD

The present invention relates to a method for producing propellant charges, intended in the first instance for tank cannons, with progressive combustion characteristics and a higher charge density (a higher charge weight per unit of volume) than previously considered possible.

PRESENTATION OF THE PROBLEM AND BACKGROUND TO THE INVENTION

In conjunction with firing a propellant gas-driven projectile from a barrel that is closed at the rear in the direction of firing, a certain initial propellant gas pressure is first required behind the projectile in order to begin to accelerate it along the barrel. Given that the part of the volume of the barrel situated behind the projectile increases successively as the projectile moves along the barrel, quantities of propellant gas which increase to a corresponding degree will be required successively during firing in order continuously to increase the velocity of the projectile for as long as it remains in the barrel. Accordingly, the ideal propellant charge would, as it burns, successively provide increasingly large quantities of propellant gas per unit of time, although in conjunction with this it must not at any time give a propellant gas pressure inside the barrel in question which exceeds the maximum permissible barrel pressure Pmax applicable to the barrel and to parts of the mechanism associated therewith. The entire propellant charge should also be fully expended when the projectile leaves the barrel, as the trajectory of the projectile can otherwise be disrupted by the exiting propellant gases, at the same time as the propellant charge cannot be fully utilized for the intended purpose.

A propellant which, as it burns under constant pressure, gives off a quantity of propellant gas per unit of time, which increases successively with the combustion time, is said to be progressive. The propellant may, for example, have acquired its progressive characteristics as a consequence of a specific geometrical form which presents a combustion area which increases the longer combustion of the same continues, although it may also have acquired its progressive characteristics as a consequence of a chemical or physical surface treatment of parts of the free surfaces of the individual grains of propellant or pieces of propellant contained in the propellant that are accessible for ignition. Propellant charges with at least limited progressive characteristics can thus be produced from granular propellant simply by the choice of an appropriate geometrical form for the grains of propellant contained in the charge.

Granular, single-perforated or multi-perforated propellants provided with through combustion channels or perforations in the longitudinal direction of the propellant grains are ignited and burn both internally in their respective perforations or combustion channels, and from the outside of the propellant grains. This means that there will be a successive increase in the inner combustion areas of the channels, and consequently in the generation of propellant gas therefrom, although at the same time the outer combustion areas of the propellant grains will be reduced as the propellant is also burnt from the outsides of the propellant grains, which gives a reduction in the generation of propellant gas from these surfaces. In order for a granular perforated propellant of this kind to be truly geometrically progressive, there is accordingly a requirement for the successive increase in the propellant channels' own combustion areas actually to exceed the simultaneous successive reduction in the outer combustion areas of the propellant grains. An externally untreated single-perforation propellant with the outer form of a true cylinder normally burns at a constant rate for this reason, whereas a 19-perforation propellant with the external form of a round bar, and similarly untreated, will normally burn progressively.

Also previously disclosed for a long time is the ability to increase the progressivity of a granular multi-perforation propellant, and also to make a single-perforation propellant progressive, by the inhibition or chemical surface treatment of the outer surfaces of the propellant grains. In conjunction with inhibition, the outer combustion areas of the propellant grains are coated with a less readily-combustible substance which delays the propagation of the ignition of the propellant along its surfaces, and in the case of surface treatment, the same surfaces are treated with an appropriate chemical substance which causes the propellant to burn more slowly along these surfaces and for a certain distance into the propellant. In accordance with a third variant, the propellant can be made progressive by coating its outer surfaces with a layer of a propellant which requires to be burnt away first before propagation of the ignition of the outer surfaces of the grains or pieces of the actual propellant charge can take place.

For a number of years, intensive work has been carried out into increasing the performance of older artillery pieces by providing them with more up-to-date ammunition. An initial limiting factor has been the stipulation that the maximum permissible barrel pressure Pmax must never be exceeded. A second previously limiting factor has been that increased performance tends to require an increased charge weight in a charge space that is already fully utilized as a rule in the case of the originally existing charges of loose granular perforated propellant. A third limitation is also that a high charge density requires a progressivity which increases in parallel.

In the case of loose granular material, however, the combined empty volume between the grains is proportionately large. One possibility would thus be to increase the density of the charge. The greatest quantity of propellant, and thus the greatest charge density and the greatest charge weight, that can be accommodated in a fixed volume is a solid body with a geometry that is adapted entirely in accordance with the available volume. However, an entirely solid body of propellant does not offer a general solution to the problem of increasing the performance of existing artillery pieces. The solid body of propellant will burn for too long, in fact, and will produce a propellant gas pressure that is too low to be utilized effectively to propel projectiles.

However, from a theoretical point of view, it is possible to conceive of producing a highly perforated block propellant which burns in a similar fashion to a larger quantity of granular multi-perforated propellant. This is not as simple in practice, however. The theoretically conceived highly perforated block propellant must accordingly be provided in its entirety with a very large number of combustion channels running in parallel, all of which are located at a distance from all adjacent combustion channels equivalent to twice the distance for which the propellant has time to burn during the period available until immediately before the time at which the projectile is intended to have exited from the barrel from which it has been fired. The distance between two combustion channels in a specific propellant is referred to as its e-dimension, and the e-dimension for the propellant that is contained in a specific charge should correspond to the distance for which the propellant has time to burn, during the firing of a specific projectile from the time of ignition until the tire at which the projectile exits from the barrel, with complete combustion during the dynamic pressure sequence in the particular artillery piece for which the propellant is intended. In order for a highly perforated propellant to be capable of being utilized optimally, it is necessary, therefore, for two adjacent perforations or combustion channels to be separated from one another by the distance of the e-dimension which is relevant in each individual case. In order to ensure the best possible firing result, the combustion time of the propellant in barrel weapons must be neither too short, as the maximum barrel pressure will then be exceeded, nor too long, as unburned propellant will then be expelled from the barrel without contributing to the acceleration of the projectile.

In the case of both the well-inhibited, granular perforated propellant and the highly perforated block propellant, the propellant ignites in all of its combustion channels, and burns radially outwards from each respective combustion channel towards the others. Thus, if the right e-dimension has been selected, the combustion surfaces from the different combustion channels will meet immediately before the passage of the projectile through the muzzle. In order to ensure that the combustion of the propellant from the outer parts of the propellant grains does not interfere with the geometrical progressivity, all of the outer propellant surfaces must ideally be inhibited, surface treated or surface coated for this purpose, including the propellant surfaces alongside the perforations.

Presented in our Swedish patent application SE0303301-6 referred to in the introduction is a new type of propellant charge for barrel weapons constructed from one, two or more propellant tubes perforated radially at selected e-dimension distances and arranged inside one another and/or after one another, which tubes burn with a certain overlap that has been achieved by the one or more tubes that are to come later in the combustion chain having been inhibited, surface treated or surface coated along all their outer surfaces in order to delay the propagation of ignition along these surfaces.

The starting material for this charge is thus highly perforated propellant tubes which have been inhibited, surface treated or surface coated, as required, in order subsequently to be arranged concentrically inside one another and/or after one another.

One difficulty encountered in the production of this type of charge is how to make the radially perforated propellant tubes. Thus, in order to be capable of being used and giving the desired result, the e-dimension at the perforations in the propellant tubes must normally lie between 0.5 mm and 10 mm, but preferably between 1 mm and 4 mm, depending on the barrel system. In order to give the desired result in the charges in question, the propellant tubes must also be perforated radially. Furthermore, the requirements for the perforation to be executed in a uniform fashion must be set very high.

PRIOR ART

The use of the highly perforated propellant block as the starting material for progressive propellant charges with a high energy content intended for barrel weapons is described in U.S. Pat. No. 766,455 dating from 1904, in which the inventor, H. Maxim, conceived of placing together a number of more or less rectangular blocks of propellant in order, by so doing, to fill the available circular cylindrical charge space as far as possible.

In SE 7728 dating from 1896, similarly with H. Maxim as the inventor, FIG. 4 also shows a drawing of a propellant charge for a barrel weapon, where the propellant charge consists of a single highly perforated propellant tube. The propellant tube illustrated in the Figure must, however, according to what is stated in the text, be in the form of a perforated propellant block that is bent together. The Figure also gives the impression that the inventor had not fully considered the practical aspect of producing a charge with such complicated geometry. The methods of manufacture proposed in the aforementioned patent specification are in reality impractical and complicated to accomplish if the appropriate perforation diameters and perforation distances are taken into consideration. It is also stated in the patent specification that the perforations are to have an effect on the propellant tube such that the propellant tube is forced against the inner wall of the charge chamber in conjunction with ignition, thereby causing it to burn from the inside only. It is doubtful, however, whether this would actually function in practice.

The same inventor is also responsible for U.S. Pat. No. 677,527 dating from 1901, in which he describes circular cylindrical artillery propellant charges produced from several layers of curved and bent highly perforated propellant blocks, which together form charges consisting of a plurality of highly perforated layers of propellant rolled concentrically one on top of the other. This patent specification gives the same impression as SE 7728, namely that, while the inventor had a clear view of the need to achieve a high charge density and progressivity, he does not seem actually to have had any clear practical perception of how the charge should actually be produced.

The present invention now relates to a method for producing propellant charges with very high charge density and high progressivity and in which we have the facility to control the combustion sequence with regard both to the release of energy and to the progressivity in a manner that is entirely different from the earlier, theoretical constructions mentioned above. The invention also includes the charge produced in accordance with the method that is characteristic thereof.

The starting material for the charge in accordance with the invention comprises two or more highly perforated propellant tubes arranged after one another and/or concentrically inside one another radially in the direction of the respective tube diameter, with circular outer and inner boundary surfaces in the direction of the cross section, in which the propagation of the ignition of the respective propellant tubes is controlled in such a way, by inhibition and/or surface coating or by coating the outer surfaces of the propellant tubes with a slower-burning propellant, that they are caused to burn one after the other but with a certain overlap. When the propellant tubes are placed inside one another, each outer propellant tube is to have an internal cavity with a cross-sectional form adapted to the outer diameter of the inner propellant tube arranged therein, and with sufficient space to accommodate the above-mentioned surface coatings with combustion-modifying substances, slower-burning propellant or the equivalent. Every propellant tube is also to be perforated in its entirety with radial perforations arranged with an e-dimension for each propellant tube which is selected with regard for the type of propellant contained therein and the desired combustion characteristics. Because the perforations are directed radially towards the central axis of the propellant tube for practical reasons, the distance between the perforations will differ slightly at the outer and inner surfaces, respectively, of the propellant tubes ($e_1 > e_2$), although, since the walls of the propellant tubes will be of limited thickness, i.e. relatively thin, similarly for practical reasons, the difference between the two e-dimensions ($e_1$, $e_2$) will be smaller the thinner the tubes become. Every propellant tube contained in the charge thus exhibits a very large number of radial perforations, where the mean distance ($e_3$) between two perforations situated next to one another is computed on the one hand by means of a first e-dimension ($e_1$) measured at the outer wall of the tube, and on the other hand by means of a second e-dimension ($e_2$) measured at the inner wall of the tube, which second e-dimension ($e_2$) is less than the first e-dimension due to the fact that the inner circumference of the tube is less than its outer circumference. The average e-dimension ($e_3$) for the propellant tube in question is then equal to $(e_1+e_2)/2$, which ideally is to be equal to the selected e-dimension.

The e-dimension ($e_1$) between the perforations on the outer periphery of the various propellant tubes that are inserted into one another will, if necessary, be capable of being adjusted mutually so that the function of the charge as a whole remains, since the mean e-dimensions ($e_3$) for the respective propellant tubes together give the desired pressure-path sequence.

Reference is made in this context inter alia to FIG. 3 in the aforementioned U.S. Pat. No. 677,527 dating from 1901, where it was considered that the problem could be solved by taking account of the fact that a sheet bent into the form of a cylinder exhibits different outer and inner radii and that the parallel perforations made in the flat state will for that reason, after bending, lie at different distances from one another on the respective outer and inner boundary surfaces of the sheet. The solution adopted in the aforementioned specification is to supplement the through perforations with additional combustion channels arranged between the through channels, which additional combustion channels are then external, i.e. they are only partially through. It is again doubtful whether such a manufacturing solution would actually function in practice, since the sheet of propellant must still be bent into the form of a tube, although only once perforation has taken place, as a result of which tensile and compressive stresses arise in the propellant material. These tensile and compressive stresses can have serious consequences in conj unction with firing of the propellant charge, and in particular at extreme ambient temperatures, since the propellant may then become brittle. The invention also includes the requirement that, in order to achieve the desired progressivity, the different propellant tubes must be ignited successively one after the other, at least to a certain extent, but must burn with the overlap required in order to give the desired progressivity, i.e. the desired successively increased production of propellant gas. This successive, mutually partially overlapping controlled propagation of the ignition of the perforated propellant tubes is achieved in that the one or more propellant tubes, which must be ignited at a later point than a previously ignited propellant tube, is/are to be inhibited, coated or surface treated along their outer and inner peripheries with an appropriate substance with the ability to slow down the propagation of the ignition of the respective propellant tubes during a space of time adapted thereto. In conjunction with this, the ends of the propellant tubes are also ideally to be inhibited, surface coated or surface treated with an appropriate substance in order to permit maximum progressivity to be achieved for the propellant.

In accordance with one specially preferred variant of the invention, combustion of the propellant tubes contained in the charge is thus controlled in that their outer surfaces have in full or in part been given an inhibition, surface treatment or surface coating adapted for the intended purpose, which results in the propellant tubes being combusted in a predetermined sequence controlled thereby, with a certain predetermined overlap between the ignition of the different propellant tubes which is similarly controlled thereby.

In the basic variant of the invention, the complete charge thus comprises one or preferably at least two propellant tubes inserted into one another and/or arranged after one another and radially perforated at selected e-dimension distances in the circular, annular cross section of the propellant tubes themselves, with the propellant tube that is intended to be ignited after the first ignited being treated or coated on its outer and inner cylindrical boundary surfaces and its ends with an inhibitor substance, which in itself may be of a previously disclosed type, or these surfaces may alternatively be screened by means of a surface coating of a slower-burning substance, for example a slow-burning propellant, which must accordingly be burned away first before ignition can be propagated to the propellant tube. If the coating consists of a slow-burning propellant, this could consist of, for example, a rolled propellant ribbon which is applied to the surfaces concerned by spiral winding or in some other way.

The sequence for the propagation of the ignition of the propellant tubes included in the charge in accordance with the invention can thus be controlled entirely at will by first causing the ignition to be propagated to an inner propellant tube and then to an outer propellant tube, or vice versa, and the same situation applies if the propellant tubes are arranged after one another or if it is a matter of combinations of these basic variants.

The different propellant tubes included in one and the same charge can, in accordance with different developments of the invention, be produced from different kinds of propellant with different rates of combustion, and can have perforations at different distances, i.e. they can have different e-dimensions and, as a result, different combustion times as well. According to one variant of the invention, the propellant tubes to which ignition is propagated at a later point in the ignition sequence should consist successively of increasingly fast-burning propellant, whereby the progressivity of the charge can be further increased.

The invention also includes the requirement that the different propellant tubes that are inserted into one another or are arranged after one another should overlap one another, at least in part, as they burn, which means that the propellant tube to be ignited and burnt before a following propellant tube should preferably have a slightly longer total combustion time than the propellant tube that is ignited later, and consequently also a larger e-dimension, or should consist of a slower-burning propellant than the propellant tube that will be burnt subsequently.

The basic embodiment of the charge in accordance with the invention that is specific to the invention may, except in the case of uniform charges, also be used in the modular charges that have become increasingly common in recent years, the basic form of which comprises a partial charge encapsulated in a combustible sleeve with the outer form of a short cylinder with a circular cross section corresponding to the cross section of the charge space of the gun in question, and where an optional number of such partial charges can be connected together to give the desired range of fire.

The invention also includes the possibility of using the space that remains internally inside the innermost of the perforated propellant tubes or propellant cylinders that are characteristic of the invention for a starter charge of loose granular propellant of a type suitable for producing the desired effect.

A further advantage of charges of the type that is characteristic of the invention is that these possess very good intrinsic strength, due to the fact that they are constructed from perforated propellant tubes inserted into one another, and that by reason of their strength they are not dependent on any external casings of metal or some other rigid material. The casings can be replaced instead by optional, light and combustible means of protection against the weather, wear and tear and the climate.

The basic component in the product in accordance with the invention is thus the radially perforated propellant tubes, which can thus be combined in a large number of different ways in which they are arranged inside one another and/or after one another, or both of these, and whose free inner volume can in turn be filled with any other type of loose propellant, such as different types of granular propellant or so-called stuck tubes or multi-perforated propellant, depending on the desired combustion characteristics for the complete charge. The fuse for initiating the charge can also be arranged in the same space.

DESCRIPTION OF THE DRAWINGS

The invention has been defined in its entirety in the following Patent Claims, and it will only be described here in slightly more detail in conjunction with the following Figures. Of these.

FIG. 6 shows a general pressure/time graph which, for a charge of the type shown in FIGS. 3 to 5, indicates the pressure in the barrel behind a projectile on its path along the barrel; while

DETAILED EMBODIMENT DESCRIPTION

Figure 1:
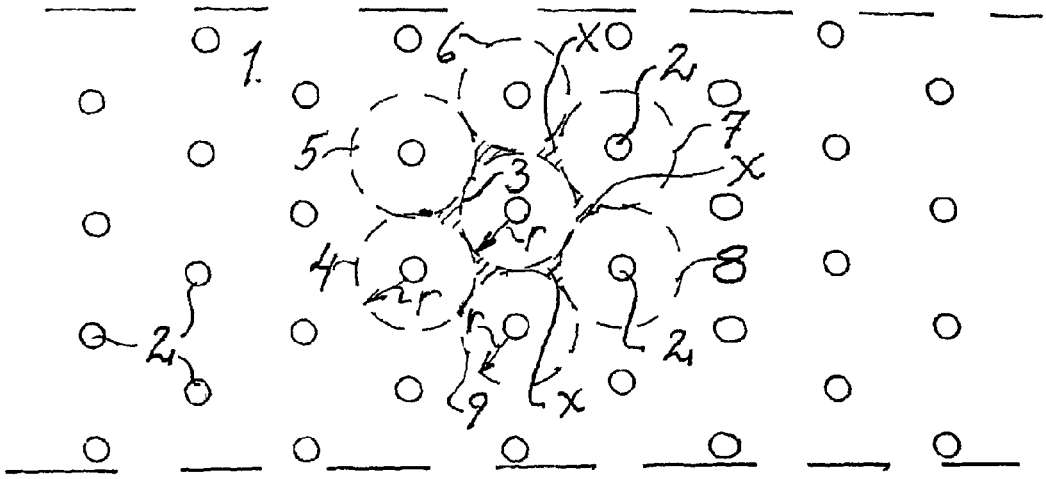
FIG. 1 shows a greatly magnified view of a small part of a perforated propellant block.

FIG. 1 accordingly shows a greatly magnified view of a small part of a perforated propellant block 1 with a very large number of perforation or ignition channels 2. The outer configuration of the propellant block 1 can be cube-shaped or tube-shaped or can exhibit any other form. The principal task of FIG. 1, which shows the part of the propellant block 1 as a view transversely across the perforation or ignition channels of the block, is to clarify the combustion sequence for a highly perforated propellant. The starting point in this case is the theoretical combustion circles 3-9, which together form an imaginary seven-perforation propellant, which, since it constitutes an inner part of the propellant block 1, can be regarded after its ignition as burning only via its respective perforation or ignition channels 2. Combustion of the propellant then takes place from the respective propellant channel 2 and radially outwards in the direction r of the arrows. It can thus be appreciated from the Figure that the combustion area of the propellant increases successively with the combustion time, i.e. combustion of the propellant is progressive until the combustion processes come together at the mutual points of contact of the combustion circles 3-9 drawn in the Figure. As can be appreciated from the Figure, a number of small quantities of propellant x, which are illustrated in the Figure with dashed lines, also remain in the corners between the combustion circles, and these quantities of propellant burn degressively together with the outer surfaces of the propellant block. This degressive contribution can be regarded as negligible, however, relative to the progressive contribution.

The e-dimension of the propellant is thus represented in FIG. 1 by the edge-to-edge distance between two adjacent ignition channels 2 or the combined radii of two contiguous circles 3-9 minus the diameter of one ignition channel. Bearing in mind the intrinsic rate of combustion of a propellant and the requirement for the propellant charge in barrel weapons to have delivered its energy to the projectile fired from the weapon before the projectile has left the barrel, the e-dimension lies between 0.5 mm and 10 mm as a rule, but preferably between 1 mm and 4 mm.

Figure 2:
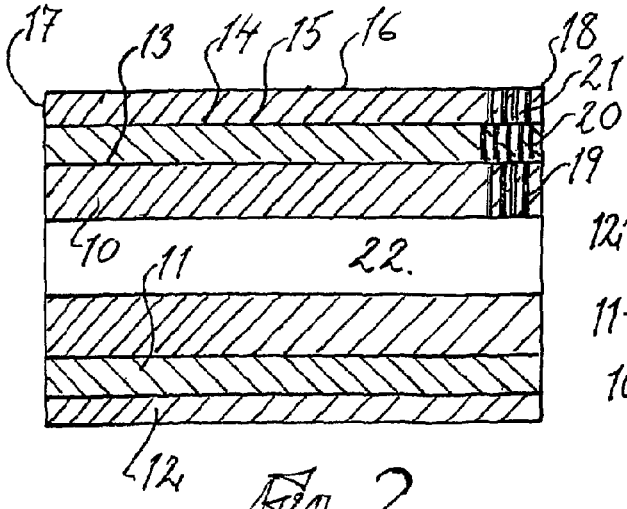
FIG. 2 shows a part of a longitudinal section of an essential three-tube propellant charge.
Figure 3:
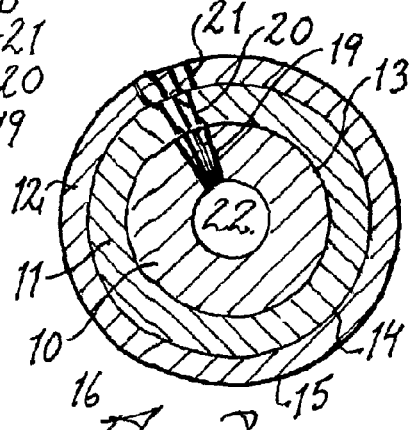
FIG. 3 shows a cross section through the charge in accordance with FIG. 2.
Figure 8:
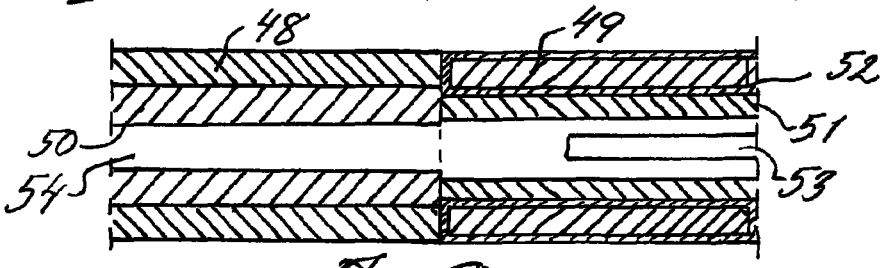
FIG. 8 shows a longitudinal section through a charge consisting of a plurality of perforated propellant tubes arranged both inside one another and after one another.

The actual invention is illustrated in FIGS. 2 and 3 in the form of a propellant charge intended for barrel weapons consisting of three propellant tubes 10, 11 and 12 inserted into one another, where each outer propellant tube is inhibited, surface treated with a substance to delay the propagation of ignition or surface coated with a layer of a propellant to delay the propagation of ignition, on both its own outside and inside and on the ends. In the Figures, these combustion-modifying layers have been given the designations 13, 14, 15 and 16, with 17 and 18 being given for the respective ends, where the latter designations apply to all ends of the propellant tubes 10-12. The inhibition, surface treatment or surface coating of at least some of the propellant tubes that is necessary for the control of combustion can also be combined with, or partially replaced by, ensuring that these propellant tubes are executed so that they are not perforated all the way through to the insides of the tubes. If it is envisaged that propagation of the ignition of the propellant tubes is to take place from the inside outwards, a relatively small quantity of propellant would accordingly require to be burned off in this variant before the combustion channels or the perforations become accessible for the propagation of the ignition. Another way of delaying propagation of the ignition between the different perforated propellant tubes, and which is illustrated in FIG. 8, is based on the principle of separating the different propellant tubes from one another with a separation layer consisting of a propellant which, in a similar fashion, must first be burned away before ignition can be propagated to the next propellant tube.

In the case of charges containing a plurality of the propellant tubes that are characteristic of the invention, the intention is thus that the different propellant tubes should be ignited one after the other but before an already ignited propellant tube has had time to burn out. Whether a previously ignited propellant tube is then an outer or an inner propellant tube is of less significance from a purely conceptual point of view. Every propellant tube is also highly perforated in its entirety in accordance with the principles already discussed in the introduction.

As can be appreciated from FIG. 3, where only a few perforations 19, 20 and 21 are consequently shown for the sake of clarity, uniform perforation around a round propellant tube means that the perforations must be directed radially, and that they will thus approach more closely to one another inwards towards the inside of the tube, and bearing in mind the significance of the e-dimension for the combustion characteristic of the propellant that has already been discussed, it is a clear advantage if a tubular charge consists of a plurality of thinner tubes inserted into one another, where the perforation distance for each tube is corrected in order to give the best possible compromise. Additional to this opportunity for controlling the combustion characteristic of the propellant is the basic idea of inhibiting propellant tubes that are lying outside or lying inside, so that these are ignited successively in a predetermined sequence with a certain mutual overlap, at the same time as the combined generation of propellant gas from all of the simultaneously burning propellant tubes is never permitted to generate a combined propellant gas pressure which exceeds the Pmax value of the discharge device in question, i.e. its highest permissible barrel pressure, and yet on the other hand, during the entire discharge sequence, is as close as possible to the maximum pressure as can be allowed during continuous service. The latter pressure is usually referred to as Pmop (maximum operational pressure). The internal cavity 22 of the inner propellant tube 10 provides space, as previously indicated, to accommodate a fuse plus an ignition charge consisting of an optional type of propellant, if required.

The charge illustrated in FIGS. 2 and 3 can in itself be regarded as constituting an example of a so-called modular charge, i.e. a type of standard charge of which a plurality can be combined to form a complete propellant charge. The outer inhibiting layers 16-18 of the charge can be executed in this case so that they also function as protection against the weather, wear and tear and the climate.

Figure 5:
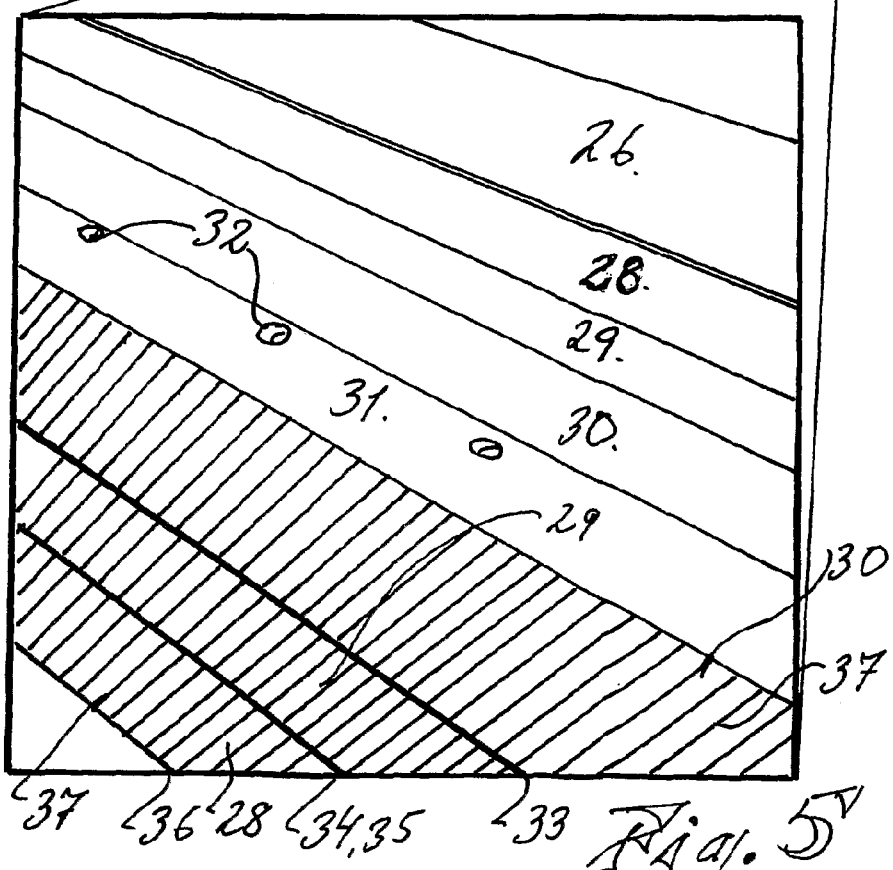
FIG. 5 shows a cut-away enlargement from FIG. 4 in accordance with the marking in FIG. 4.
Figure 6:
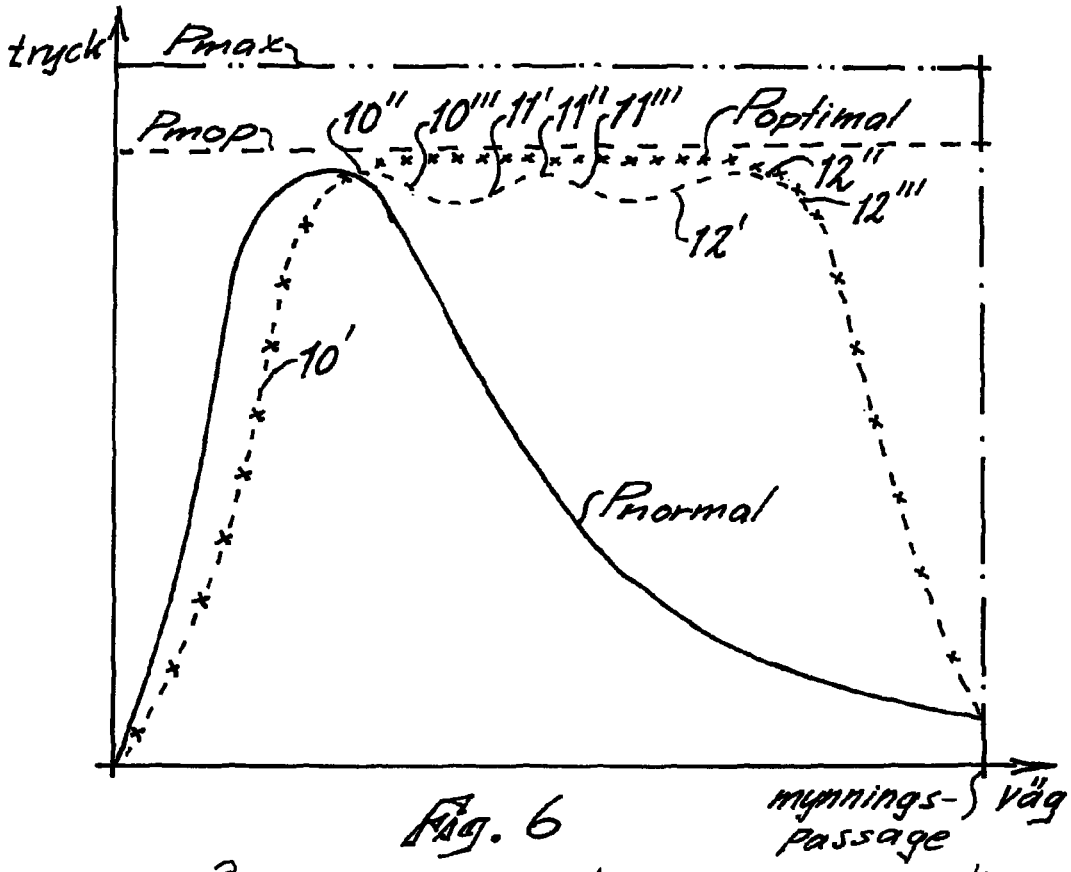

When correctly designed, a charge of this kind gives a pressure-path sequence of the type shown in FIG. 6, where a propellant tube, e.g. the inner propellant tube 10, is ignited first and, thanks to its own perforation, produces a progressive combustion sequence in accordance with the part of the curve 10', which reaches its maximum at 10", after which the generation of propellant gas from this propellant tube on a level with 10'" begins to diminish, although since, if the ignition of the propellant tubes is propagated from the inside outwards, the propellant tube 11 will already have been ignited before the propellant tube 10 has reached its maximum, the production of propellant gas from this second propellant tube will, at the same time, begin to provide a significant additional amount of propellant gas while the propellant tube 10 burns out. The curve 12 in FIG. 6 shows the propellant gas pressure available in the barrel behind the fired projectile on each occasion. The propellant tube 11 consequently now contributes with the progressive part 11' of the curve and thereby restricts the downward trend of the curve, at the same time as the propellant tube 11 provides a maximum contribution at 11". In a similar fashion to that for the propellant tube 10, the diminishing production of propellant gas by the propellant tube 11 will result in a slight decrease in the combined generation of propellant gas at 11'", at the same time as the addition of propellant gas from the propellant tube 12 makes its contribution in an equivalent fashion in the form of a slight increase at 12', and a maximum at 12", after which the entire pressure curve falls rapidly, so that the propellant gas pressure behind the fired projectile as it passes through the muzzle is so low that the laying of the projectile on its intended trajectory is not disturbed. Also shown in FIG. 6, on the one hand, is the maximum permissible barrel pressure Pmax for a single round and, on the other hand, Pmop (maximum operational pressure), which should be approached as closely as possible in continuous service in order to achieve a maximum range of fire. The theoretically optimal curve for a propellant charge has been given the designation Poptimal in the Figure (indicated in the Figure with a cross), and the type of pressure-path curve associated with today's conventional granular propellant has been given the designation Pnormal. Since the granular propellant has a very substantial initial combustion surface, it very quickly gives rise to a maximum pressure which then falls at a far too early stage. On the other hand, as can be appreciated from the Figure, the result obtained in accordance with the invention lies very close to the theoretical optimal value. The pressure-path discussion conducted here is also applicable to the charge in accordance with FIG. 4 and FIG. 5. As can also be appreciated from the curve, there is a requirement that the generation of propellant gas should essentially have ceased entirely immediately before the projectile leaves the muzzle of the barrel.

Figure 4:
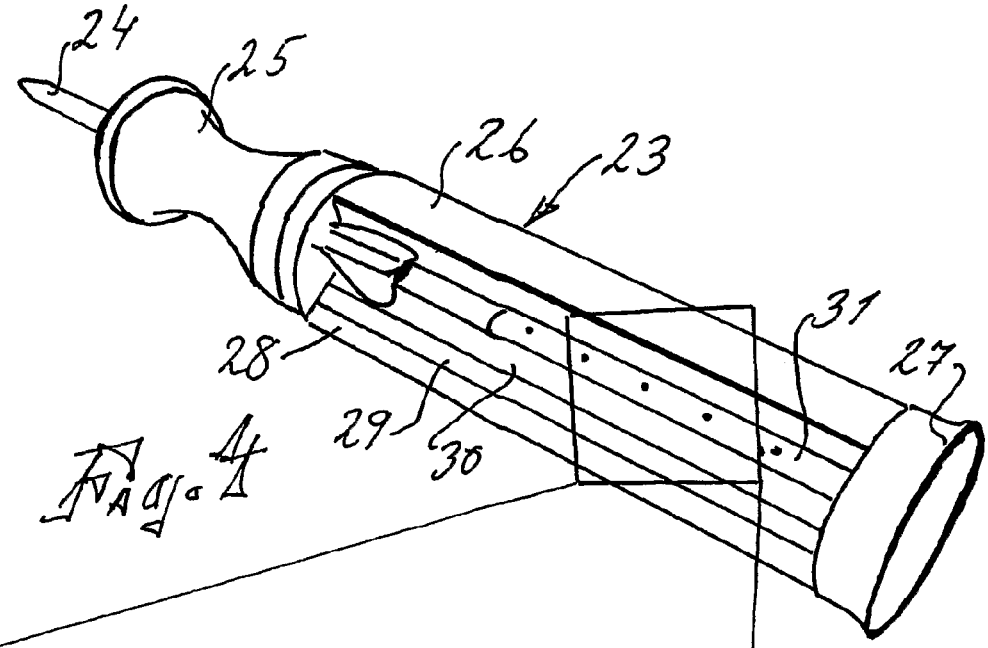
FIG. 4 shows a partially sectioned complete round.

The complete round 23 illustrated in FIG. 4 and partially in FIG. 5 consists of a subcaliber armour-piercing arrow projectile 24 with an associated sabot 25, a case 26 with a base 27 and one of the three propellant tubes 28-30 inserted into one another and the long fuse 31 with its ignition apertures 32 as shown in FIG. 5.

It can also be appreciated from FIG. 5 that the charge (it is in fact partially sectioned in the Figure) consists of three propellant tubes 28-30 inserted into one another, where the two outer propellant tubes 28 and 29 are inhibited on all their outside surfaces 33-36 as well as on the ends that are not included in the Figure. It can also be appreciated from FIG. 4 that the different propellant tubes 28-30, at least with regard to propellant tube 30 in relation to propellant tubes 28 and 29, are of different thickness, and that their perforations, all with the designation 37, are made with different e-dimensions (the perforations 37 have not been drawn in FIG. 4, because this was not permitted by the scale of the Figure). A development of the invention also provides for the different propellant tubes to be made with different types of propellant with different rates of combustion, in conjunction with which a faster-burning propellant is preferably used in propellant tubes that are to be ignited at a later stage, and a rather more slow-burning propellant is used in the propellant tubes that are to be ignited first.

Figures 7A, 7B, 7C:
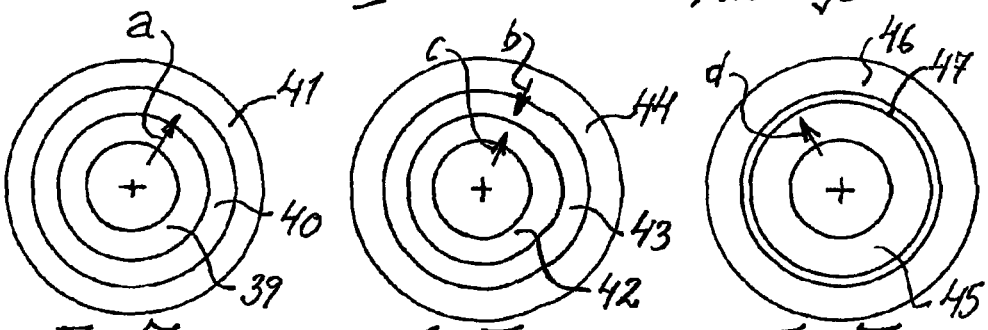
FIGS. 7*a-c* show, by way of cross sections through a number of charges, different ignition propagation possibilities for these.

FIGS. 7*a-c* show, as already mentioned, a number of different variants for the propagation of ignition between the different propellant tubes. Any other variant that falls within the underlying idea characterizing the invention is also conceivable.

The charge in accordance with FIG. 7*a* thus comprises three radially perforated propellant tubes 39-41 of the type that is characteristic of the invention. The arrow a denotes that propagation of the ignition of the propellant tubes is intended to take place from inside the centre of the charge and outwards. The outer propellant tubes 40 and 41 are therefore assumed to be inhibited or surface-treated in a previously discussed fashion, so that the desired partially overlapping and mutually delayed propagation of the ignition is achieved.

FIG. 7*b* similarly shows a charge consisting of three propellant tubes 42-44 arranged inside one another, where it is envisaged that propagation of the ignition will take place both from the outside inwards in accordance with the arrow b, and from the inside outwards in accordance with the arrow c. In this variant, it is thus the middle propellant tube 43 that has been provided with inhibited or surface-treated outer surfaces to delay propagation of the ignition. Of course, all of the propellant tubes contained in the charge are radially perforated. They can also be made from different types of propellant with different rates of combustion.

FIG. 7*c*, finally, shows a two-tube propellant charge consisting of the radially perforated propellant tubes 45 and 46, where the outer surface of the outer propellant tube 46 is prevented from burning, for example by the application of an inhibitor. The aforementioned two propellant tubes 45, 46 are intended to be ignited by propagation from the inside outwards in accordance with the arrow d, although in this illustrative embodiment propagation of the ignition between the propellant tubes 45, 46 is slowed down by a layer 47, which is arranged between the propellant tubes 45, 46, or by a surface coating 47 on the inner surface of the outer propellant tube 46 consisting of a slow-burning propellant 47, which must be burned away before ignition can be propagated to this propellant tube 46.

FIG. 8, in conclusion, shows a longitudinal section of part of a developed variant of the charge in accordance with the invention comprising a plurality of radially perforated propellant tubes arranged after one another and inside one another (as in several of the earlier Figures, the scale of the Figures did not permit the direct illustration of the perforations). The Figure shows four different propellant tubes 48-51, where the propellant tubes 50 and 51 are arranged inside the propellant tubes 48 and 49, respectively. It is envisaged that all of the outside and inside surfaces of the propellant tube 48 are inhibited or surface-treated, while the propellant tube 49 is surface-coated with, or perhaps rather embedded in, a delaying propellant 52. In order to exemplify the flexibility of the invention, it is envisaged that the propellant tubes contained in the charge are made from different types of propellant. Also shown in the Figure are parts of a fuse 53, at the same time as the free space 54 at the centre of the inner propellant tubes 50, 51 is intended to be filled with loose granular initiating propellant.

The invention claimed is:

1. Method of combustion for tubular propellant charges with a very high charge density and high progressivity for barrel weapons, the method comprising:

radially perforating at least two propellant tubes which have circular outer and inner boundary surfaces in their entirety with combustion or ignition channels at an e-dimension distance selected in relation to the actual type of propellant and the desired combustion characteristics of said propellant tubes, treating at least one of the total number of outer surfaces of these propellant tubes that are available for initiation with an inhibition, surface treatment or surface coating, delaying the propagation of ignition of said all outer surfaces of at least one propellant tube, so that ignition of the propellant tubes is successively done one after the other and combustion of a propellant tube is partially mutually overlapping the combustion of the next propellant tube such that the maximum pressure within the barrel weapon resulting from each combustion is equal to or slightly below a maximum operational pressure of the barrel weapon, and selecting a first propellant tube from among the at least two propellant tubes with a different e-dimension distance in relation to the e-dimension distance of a second propellant tube from among the at least two propellant tubes.

2. Method in accordance with claim 1, further comprising:

arranging at least two of the perforated propellant tubes of the charge one after the other.

3. Method in accordance with claim 2, further comprising:

treating each propellant tube to be entirely ignited by propagation, after another propellant tube has previously been ignited by propagation, with an inhibition, surface treatment or surface coating with a substance intended to delay the propagation of ignition along its respective outer boundary surfaces, so that the desired delay in the propagation of ignition is achieved.

4. Method in accordance with claim 2, characterized in that the inhibition, surface treatment or surface coating of each propellant tube to be ignited by propagation, after another propellant tube has previously been ignited by propagation, is executed in such a way that only limited declines in the jointly increasingly generation of propellant gas by the entire charge occur during the total combustion of the latter.

5. Method in accordance with claim 2 for the production of so-called modular charges consisting of propellant unit charges encapsulated in a combustible housing or means of protection against the weather, climate and/or wear and tear, which charges are executed in such a way that they are capable of being combined in an optional number to form charges with the desired energy content, where each such part charge exhibits a central ignition channel to facilitate the propagation of ignition between all part charges combined together to form a unit, characterized in that combined within each modular charge are at least two highly perforated propellant tubes, of which each outer propellant tube is inhibited, surface-treated or coated with a substance having a different rate of combustion along its outer surfaces such that the propellant tubes are caused to ignite by propagation in a predetermined and mutually partially overlapping ignition sequence.

6. Method in accordance with claim 1, further comprising:

arranging at least one of the propellant tubes of the charge inside the internal cavity of an outer propellant tube.

7. Method in accordance with claim 6, further comprising:

treating each propellant tube to be entirely ignited by propagation, after another propellant tube has previously been ignited by propagation, with an inhibition, surface treatment or surface coating with a substance intended to delay the propagation of ignition along its respective outer boundary surfaces, so that the desired delay in the propagation of ignition is achieved.

8. Method in accordance with claim 6, characterized in that the inhibition, surface treatment or surface coating of each propellant tube to be ignited by propagation, after another propellant tube has previously been ignited by propagation, is executed in such a way that only limited declines in the jointly increasingly generation of propellant gas by the entire charge occur during the total combustion of the latter.

9. Method in accordance with claim 6 for the production of so-called modular charges consisting of propellant unit charges encapsulated in a combustible housing or means of protection against the weather, climate and/or wear and tear, which charges are executed in such a way that they are capable of being combined in an optional number to form charges with the desired energy content, where each such part charge exhibits a central ignition channel to facilitate the propagation of ignition between all part charges combined together to form a unit, characterized in that combined within each modular charge are at least two highly perforated propellant tubes, of which each outer propellant tube is inhibited, surface-treated or coated with a substance having a different rate of combustion along its outer surfaces such that the propellant tubes are caused to ignite by propagation in a predetermined and mutually partially overlapping ignition sequence.

10. Method in accordance with claim 1, further comprising:

treating each propellant tube to be entirely ignited by propagation, after another propellant tube has previously been ignited by propagation, with an inhibition, surface treatment or surface coating with a substance intended to delay the propagation of ignition along its respective outer boundary surfaces, so that the desired delay in the propagation of ignition is achieved.

11. Method in accordance with claim 10, characterized in that the inhibition, surface treatment or surface coating of each propellant tube to be ignited by propagation, after another propellant tube has previously been ignited by propagation, is executed in such a way that only limited declines in the jointly increasingly generation of propellant gas by the entire charge occur during the total combustion of the latter.

12. Method in accordance with claim 1, characterized in that the inhibition, surface treatment or surface coating of each propellant tube to be ignited by propagation, after another propellant tube has previously been ignited by propagation, is executed in such a way that only limited declines in the jointly increasingly generation of propellant gas by the entire charge occur during the total combustion of the latter.

13. Method in accordance with claim 1 for the production of so-called modular charges consisting of propellant unit charges encapsulated in a combustible housing or means of protection against the weather, climate and/or wear and tear, which charges are executed in such a way that they are capable of being combined in an optional number to form charges with the desired energy content, where each such part charge exhibits a central ignition channel to facilitate the propagation of ignition between all part charges combined together to form a unit, characterized in that combined within each modular charge are at least two highly perforated propellant tubes, of which each outer propellant tube is inhibited, surface-treated or coated with a substance having a different rate of combustion along its outer surfaces such that the propellant tubes are caused to ignite by propagation in a predetermined and mutually partially overlapping ignition sequence.

14. Propellant charge for barrel weapons having a circular outer cross section and a very high charge density and high progressivity produced in accordance with the method in accordance with claim 1, characterized in that it comprises two or more radially highly perforated propellant tubes arranged concentrically inside one another and/or directly after one another and with circular outer and inner cross sections, where each outer propellant tube has an inner cavity with a cross-sectional form adapted to the outer diameter of an inner propellant tube that may be arranged therein, and where each propellant tube in its entirety is perforated with combustion or ignition channels arranged radially in the cross section of the propellant tubes, which channels are separated from one another at distances or e-dimensions adapted for the respective propellant tube in relation to the desired combustion times and the type of propellant contained therein.

15. Propellant charge in accordance with claim 14, characterized in that the propellant tubes have been given a previously determined and mutually partially overlapping ignition sequence by inhibition, surface treatment or surface coating with a substance having a lower rate of combustion than the propellant tube itself at the time of initiation of the charge.

16. Propellant charge in accordance with claim 15, characterized in that said propellant charge comprises layers of a propellant for delaying the propagation of ignition arranged between the different propellant tubes.

17. Propellant charge in accordance with claim 14, characterized in that said propellant charge has been shaped externally as a modular charge.

18. Propellant charge in accordance with claim 14, characterized in that the different propellant tubes are produced from different propellants with different rates of combustion and perforated at different e-dimension distances.

19. Propellant charge in accordance with claim 14, characterized in that, for a plurality of propellant tubes arranged inside one another, a propellant tube previously ignited by propagation has, by means of a selected e-dimension and/or a selected type of propellant, been given a longer combustion time than a propellant tube subsequently ignited by propagation.

20. Propellant charge in accordance with claim 14, characterized in that the inner cavity of the innermost propellant tube of the charge has been adapted to accommodate a fuse for the initiation of the charge, which fuse can be combined with an ignition propagation charge consisting of loose granular propellant.

21. Method in accordance with claim 1, wherein the generation of propellant gas has essentially ceased entirely immediately before a projectile leaves a muzzle of the barrel weapon.

22. Method in accordance with claim 1, further comprising:

replacing a loose granular perforated propellant with the at least two propellant charges.

* * * * *